US005478461A

United States Patent [19]

Sala et al.

[11] Patent Number: 5,478,461

[45] Date of Patent: Dec. 26, 1995

[54] METHOD OF REGENERATING NICKEL-PLATING BATHS CONTAINING NICKEL SULFAMATE

[75] Inventors: Béatrice Sala, Jonzieux; Laurent Guerin, St Just Malmont; Francoise Larue, Versailles, all of France

[73] Assignee: Framatome, Courbevoie, France

[21] Appl. No.: 939,489

[22] Filed: Sep. 8, 1992

[30] Foreign Application Priority Data

Sep. 6, 1991 [FR] France ..... 91 11058

[51] Int. Cl.[6] ..... C25D 3/12

[52] U.S. Cl. ..... 205/101; 204/129; 204/130

[58] Field of Search ..... 205/101, 99; 204/130, 204/129

[56] References Cited

FOREIGN PATENT DOCUMENTS 0690712 7/1964 Canada ..... 205/99
1101093 6/1965 United Kingdom .

*Primary Examiner*—Kathryn Gorgos
*Attorney, Agent, or Firm*—Pollock, Vande Sande & Priddy

[57] ABSTRACT

A method of regenerating a nickel-plating electrolytic bath containing nickel sulfamate, prior to nickel plating, comprises the steps of subjecting the bath to a reduction treatment to render the bath unable to be used for electrolytic nickel-plating and slowly oxidizing the bath until it is again suitable for nickel-plating.

11 Claims, 2 Drawing Sheets

METHOD OF REGENERATING NICKEL-PLATING BATHS CONTAINING NICKEL SULFAMATE

BACKGROUND OF THE INVENTION

The present invention relates to the field of nickel-plating by means of nickel-plating baths using nickel sulfamate as the nickel-providing compound, and provides a method of regenerating such baths. A particularly important application of the invention lies in regenerating nickel-plating baths used for plating structural components of a nuclear power station, in particular certain zones in the tubes of steam generators, such as those used in pressurized water reactors.

It is known that nickel-plating of the inner surfaces of the U-shaped regions of the tubes in a steam generator, i.e., the regions where the tubes are subjected to particularly high stresses, may close microcracks or prevent such cracking from taking place. For an example of a nickel-plating repair method, reference may be made to EP-A-0 167 513.

It is conventional to use nickel-plating baths in which the nickel-providing ingredient is nickel sulfamate. These baths suffer from the drawback of oxidizing and of causing fast passivation of anodes.

Boric acid has also been used to achieve an optimum pH, essential for obtaining good electrochemical conditions for nickel-plating and to avoid decomposition of nickel sulfamate due to hydrolysis.

Proposals have further been made to avoid anode passivation by adding chloride to the bath.

SUMMARY OF THE INVENTION

It is an object of the invention to provide a method of regenerating nickel sulfamate baths which avoids adding any metal that could disturb the nickel-plating process or could lead to a layer containing foreign elements that are detrimental. An ancillary object of the invention is to obtain good dissolution of the nickel electrodes, in particular the anodes, to retard passivation thereof, and to obtain a constant distribution of the coating of the cathode constituted by the part to be processed, in spite of the non-uniformities that are often present in nickel-plating cells.

According to one aspect of the invention, a method for regenerating nickel-plating baths containing sulfamate includes the steps of subjecting the bath to a reduction treatment until it has a composition that prevents nickel-plating, followed by gentle and controlled oxidation to bring it back to a condition permitting electrolytic nickel-plating.

Gentle and controlled oxidation should be construed as meaning slow oxidation carried out under such conditions that it always remains possible to stop the process without substantial changes in the oxidation state from the time the termination step is initiated to the time where steady conditions are restored.

In practice, reduction will typically be carried out until compounds of the hydrazidomonosulfonate type appear in the bath, which compounds have reducing properties comparable to those of hydrogen.

In particular implementations, the sulfamate bath is treated by adding a chemically reducing compound that does not bring a disturbing cation, optionally together with a catalyst, and/or by internal electrolysis for a period of at least one hour under an inter-electrode voltage between 5 volts and a minimum value that creates a current density of 0.3 mA/cm$^2$, with the current density not exceeding 3 mA/cm$^2$.

Experience has shown that a voltage of 5 volts suffices for most anode-to-cathode distances currently found. It has also appeared that during electrolysis it is desirable to avoid exceeding a potential of 600 mV relative to a reference mercurous sulfate electrode (which corresponds to 650 mV relative to hydrogen).

Electrolysis generates hydrogen, and it may be supplemented or replaced by introducing hydrogen to the bottom of the bath in a manner that is sufficiently spread out to ensure that the bubbles of hydrogen sweep over the cathode as they rise through the bath.

During the reduction stage, the bath is advantageously placed under an inert atmosphere, e.g., of argon, to avoid simultaneous oxidation.

Controlled oxidation is typically carried out in air at a temperature of less than 80° C. for a period of time of from half an hour to 24 hours, before the bath is used.

The effect of the treatment can be monitored during the treatment by testing or verifying samples. Such testing also serves to determine the state of baths prior to regenerating them and to evaluate the length of time that will be required for reduction.

In particular, it is possible to use:

- a potentiokinetic test during which the polarization curve is drawn. To this end a cathode, a nickel anode, and a mercurous sulfate reference electrode are immersed in the sample: during the test, the potential difference between the anode and the cathode is brought to a given value and then maintained. The length of time required to reach passivation is then observed, as revealed by a bend in the curve of anode potential relative to the reference electrode plotted as a function of current density; or
- a nickel-plating test during which a potential difference is applied between the two electrodes, under two different polarizing conditions:
  a rise from 0 V to 2.7 V over one minute; and
  maintaining 2.7 V throughout the nickel-plating time.

The overall current (and thus the current density) and the voltage Ea of the anode are recorded as a function of time.

Passivation appears when the current drops suddenly and the voltage increases.

The conditions under which internal electrolysis takes place are selected in such a manner as to generate very reactive hydrogen in situ, without degrading the bath. Reduction by means of hydrogen may take place simultaneously with or following a stage of reduction by some other means, and is performed by bubbling a hydrogen-containing gas into the bath onto a catalyst, the hydrogen-containing gas being hydrogen or a mixture of argon and hydrogen. As an alternative to using hydrogen, the reduction step may be performed by a reducing compound such as hydresine or nickel sulfites.

For reasons of reaction kinetics, it is preferable for the area of the cathode to be large compared with the volume of the solution: it should be at least 20 cm$^2$/1 of solution and is advantageously 35 cm$_2$/1 to 40 cm$^2$/1 of solution. It may be constituted, in particular, by balls, by a grating, or by shavings so as to diffuse a sufficient quantity of hydrogen into the bath. The area of the anode should be no smaller than that of the cathode so as to obtain low current density to minimize the oxidation processes that take place at its surface.

The electrodes used for regeneration are constituted by a metal which does not pollute the bath on dissolving. The motal must have a catalytic effect on the reduction process. Use may be made, for example, of nickel or of a material which has known catalytic properties, such as platinum, and which is of a nature such as not to pollute the bath. The cathode is maintained in the hydrolysis cell to serve as a catalyst during the chemical reduction step.

The applied potential is a function of the constants of the electrolysis cell, i.e., the area of the electrodes and the distance between them, and it is applied so as to cause hydrogen to be given off at the cathode without having an oxidation process in the sulfamate bath, and this is done by monitoring the anode potential. In the two examples given, this potential lies in the range 1 V to 2 V. The parameters are determined by preliminary tests as a function of the electrolysis cell used, namely the ratio of the electrode areas (anode area divided cathode area should not be less than 1) and the distance between the electrodes (whose influence is only slightly perceptible).

The electrolysis time, which may be as much as several hours, is a function of the rate of sulfamate hydrolysis that can be accepted by the nickel-plating process.

BRIEF DESCRIPTION OF THE DRAWINGS

The invention will be better understood on reading the following description of methods constituting particular implementations of the invention, and of a device enabling the methods to be performed, reference being had to the attached drawings, of which.

DESCRIPTION OF THE PREFERRED EMBODIMENT

Figure 1:
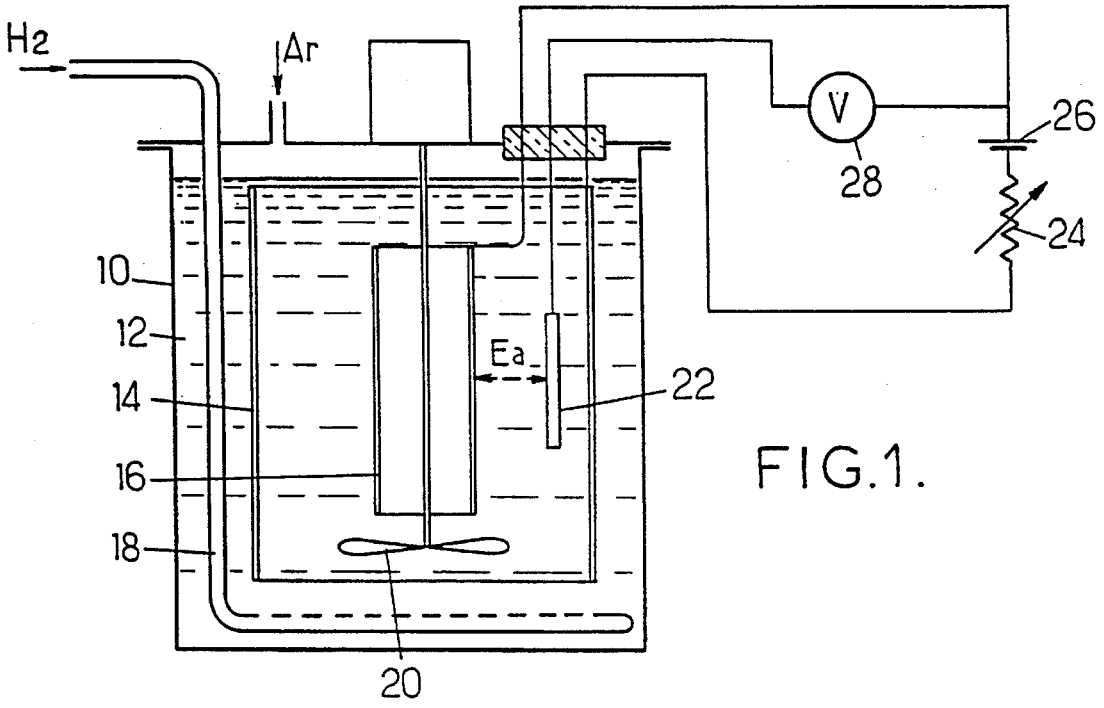
FIG. 1 is a diagram of a regeneration cell enabling a method of the invention to be performed.

The device shown schematically in FIG. 1 comprises a tank 10 for receiving the bath 12 to be regenerated. A large diameter vertical tubular cathode 14 and a similarly tubular central anode 16 disposed coaxially with the cathode are immersed in the bath. A feed pipe 18 enables bubbles of hydrogen or of a mixture of hydrogen and argon to be released at the bottom of the tank in such a manner that bubbles of hydrogen sweep over the wall of the cathode 14. In the embodiment shown, a stirrer 20 is placed in the center of the tank.

The cathode may be made of nickel, of a nickel-based alloy, or of a metal that constitutes a catalyst for hydrogenation, e.g., platinum. The anode's generally made of nickel.

A reference electrode 22, generally mercurous sulfate, is also immersed in the bath, for the purpose of monitoring the reduction operation.

The anode and the cathode are connected by means of a rheostat 24 to the terminals of a DC source 26 for providing a voltage of a few volts. A voltage measuring device 28 whose measuring range need not exceed 600 mV is connected between the anode 16 and the reference electrode 22. The measuring device provides the potential Ea of the anode relative to the reference electrode.

In general, reduction takes place by keeping the voltage between the anode and the cathode at a constant value while monitoring the potential of the anode relative to the reference electrode, to ensure that this potential never exceeds 600 mV.

The electrolytic and/or chemical reduction state is determined on the basis of electrochemical tests such as the nickel-plating test, and by establishing the polarization curve.

A polarization curve may be established, in particular, as follows.

The following are placed in the nickel-plating solution: a cathode (an electrode of nickel-chromium-iron alloys known as INCONEL) and an anode (a sulfur nickel electrode whose depolarized face is placed facing the cathode). The electrodes are initially subjected to acid cleaning followed by washing in water; they are then polarized in a solution of sulfamic acid containing nickel sulfamate.

Then, after drying without washing, they are inserted into the nickel sulfamate bath to be tested.

The anode is polarized relative to a mercurous sulfate reference electrode at a predetermined speed of polarization.

It is advantageous to adopt a speed of increase in total voltage between the anode and the cathode that corresponds to the rate of current increase selected for the nickel-plating tests. In practice, the voltage may be raised from 0 volt to 2.7 volts over one minute. This value of 2.7 volts makes it possible to reduce the duration of the test when performing a nickel-plating test. However, to retard passivation, it may be preferable under steady conditions to use a voltage of less than 2.7 volts.

A recording is made of the current response taken between the anode and the cathode (representative of the electrochemical processes taking place at the surfaces of the electrodes and in the solution). A curve Ea=f(I) is thus obtained (where Ea is the potential difference between the reference electrode and the anode).

Figure 2:
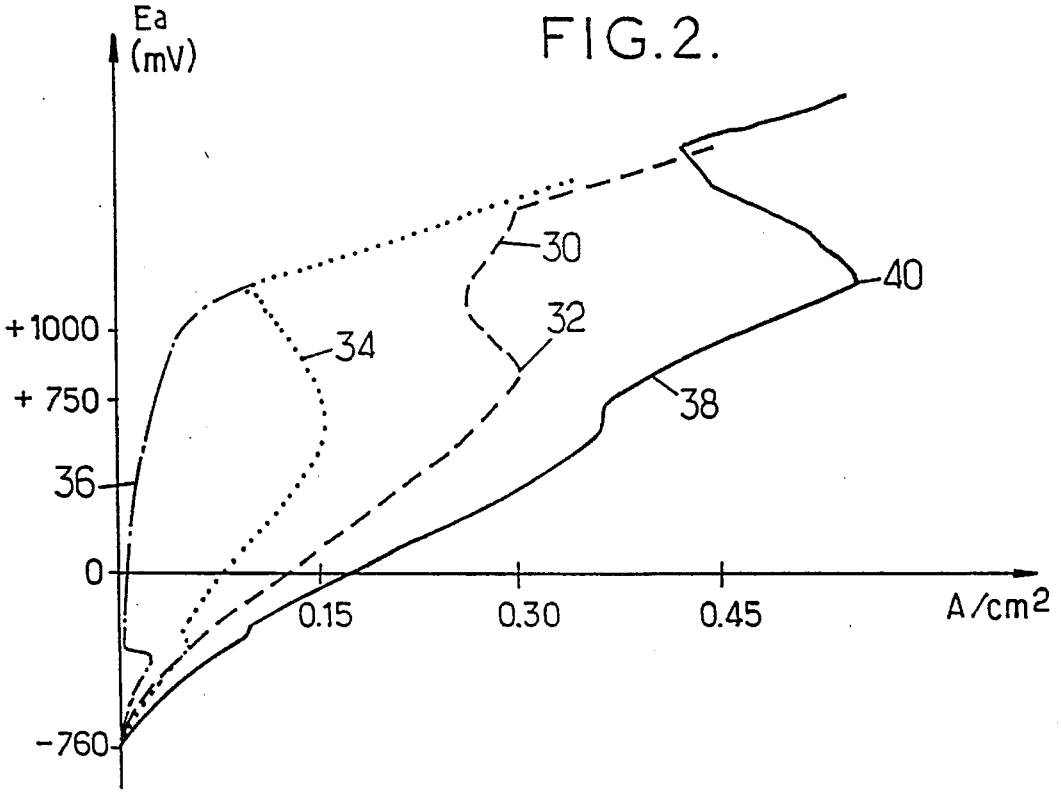
FIG. 2 is a graph of curves representative of the variation in anode potential relative to the reference electrode as a function of current density during a potentiokinetic test.

FIG. 2 shows the appearance of curves obtained with nickel-plating baths in various different states.

Curve 30 shows the appearance of the change in polarization potential relative to the reference electrode as a function of current as time elapses for a bath that has become unsuitable for nickel-plating. After about five minutes, a bend 32 can be seen to appear in the curve revealing an oxidized state. After the same bath has been reduced, a test performed on a sample gives rise to curve 34 with anode passivation taking place after a very short period of time: about one minute. With complete reduction, as obtained, for example, by using hydrazine, it is possible to reach a state corresponding to the curve shown at 36.

After controlled reoxidation, the curve obtained on a sample is of the kind shown at 38. Anode passivation as revealed by the bend 40 does not appear until after 32 minutes.

Figure 3:
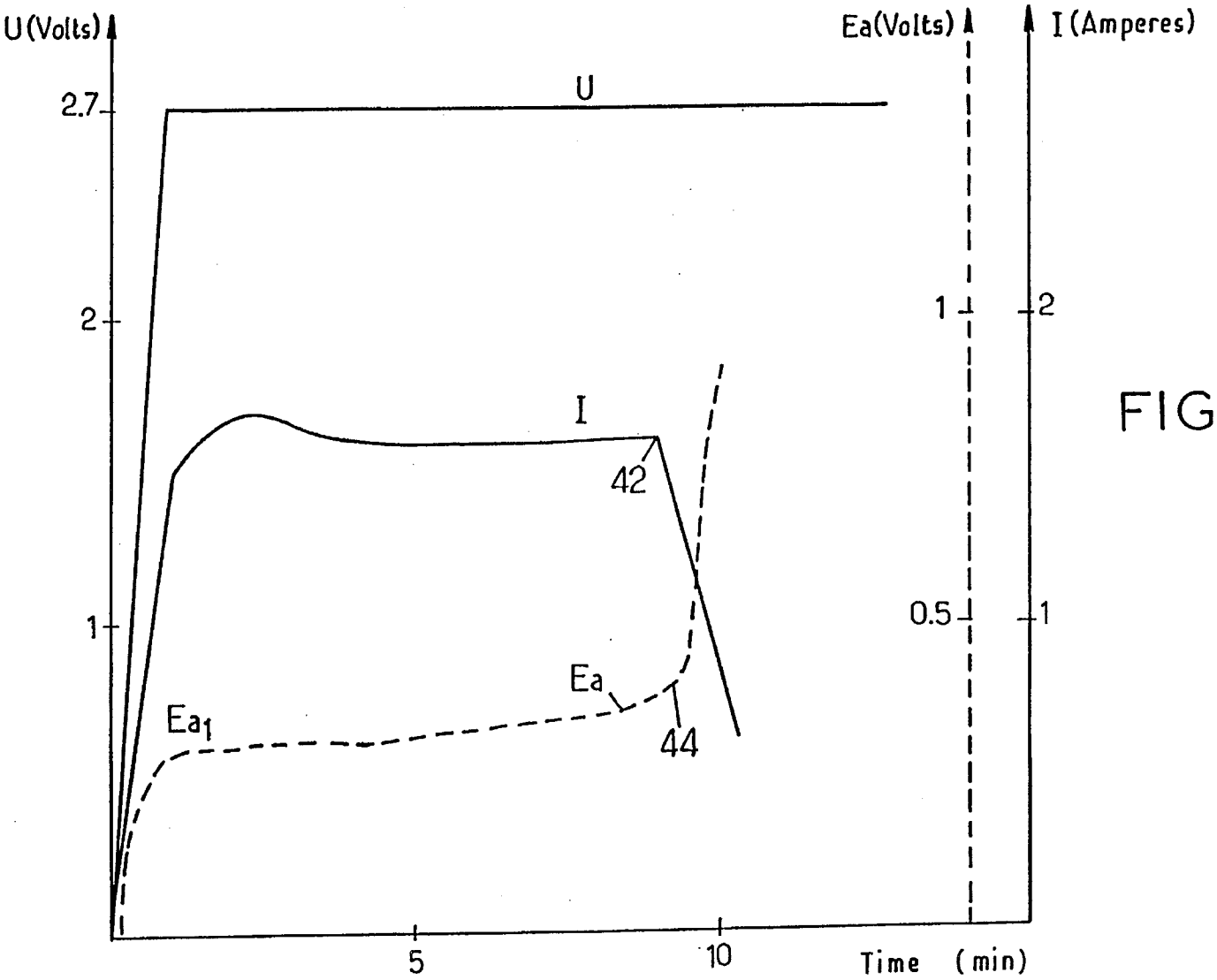
FIG. 3 is a graph of curves representative of parameter variation as a function of time during a two-electrode nickel-plating test.

Nickel-plating tests may be performed by means of an electrochemical installation comparable to that shown in FIG. 1. The variation as a function of time of the current I, of the potential relative to the reference electrode, and of the total voltage U between the anode and the cathode (which voltage is maintained constant after rising linearly from 0 volt to 2.7 volts over one minute) are of the kind shown in FIG. 3. It can be seen that with the sample under investigation, passivation as revealed by the bends 42 and 44 appears after eight to nine minutes.

It can be seen that on a polarization curve the current density should be cut by at least half at the end of reduction, with this happening over a wide range of potentials Ea relative to reference electrode (going from curve 30 to curve 34). However, nickel-plating would be practically impossible using a bath in that state. For nickel-plating to take place properly, it is desirable to reduce the bath beyond the amount that is necessary and then to subject the solution to gentle oxidation using air below 80° C., and advantageously above 50° C., for a minimum time of half an hour up to a maximum time in the range 12 hours to 24 hours.

This method offers numerous advantages: it enables the oxygen compounds obtained both during nickel-plating and during the time the bath is exposed to air to be reduced, and it enables the oxidoreduction state of sulfamate baths to be stabilized, thereby retarding anode passivation. The anodes may be nickel anodes containing sulfur to a concentration not exceeding 0.12% by weight.

The following examples given purely by way of illustration make it easier to understand the method of the invention for regenerating a nickel-plating bath containing sulfamate.

EXAMPLE 1

The bath to be regenerated comprises a solution of nickel sulfamate that causes the soluble anode immersed therein to be passivated, which is detrimental to nickel-plating.

A volume of one liter of the bath constituted by a nickel sulfamate solution containing 90 g/l to 95 g/l of nickel and 30 g/l to 40 g/l of boric acid is electrolyzed for one hour to two hours between two electrodes, a sulfur-depolarized nickel anode constituted by a grid having an area of 150 $cm^2$, and an "Inconel 600" alloy cathode constituted by a grid having an area of 150 $cm^2$. A direct current having a density of 1 $mA/cm^2$to 0.03 $mA/cm^2$ is applied to the cathode at a voltage of 1.8 volts.

Simultaneously, gas is injected by being bubbled through at a rate of 800 $cm^2$/min. The gas used is either hydrogen or a mixture of argon and hydrogen, e.g., containing about 15% hydrogen. The solution is advantageously placed under an inert atmosphere, in particular under argon, in order to avoid simultaneous oxidation. This hydrogen reduction is continued for at least five hours after electrolysis and may continue for ten to one hundred hours. The reduction effect is monitored by polarization curves plotted as described above and as shown in FIG. 2, which relates to Example 1. The reduction step is then followed by gentle oxidation in the range 50° C. to 80° C. for a period of time in the range of half an hour to 20 hours.

From the polarization curve, V=f(I) where V=Ea/ESM, i.e., the potential difference between the mercurous sulfate reference electrode and the anode are expressed in mV, and where I=ddc or current density expressed in $A/cm^2$, it can be seen that the current is much greater than the current recorded initially. In addition, the diffusion plateau recorded at about 1.2 volts relative to the mercurous sulfate electrode and characteristic of the presence of an oxygen-containing compound, is eliminated. Nickel-plating than becomes possible and the length of time the bath can be used is increased.

EXAMPLE 2

An amount of 25 liters of a nickel sulfamate solution having the same composition as in Example 1 is electrolyzed at a voltage of 1.8 V, with a current density of 0.03 $mA/cm^2$, using a nickel cathode having an area of 9300 $cm^2$ and an anode having an area of 12400 $cm^2$ (the real areas of grids).

The current is applied for one to two hours at a temperature in the range 50° C. to 80° C.

Reduction is continued for at least five hours under hydrogen with the nickel catalyst. Gentle oxidation is performed between 50° C. and 80° C. for a period of time in the range half an hour to 20 hours.

The bath regenerated in this way enables a nickel-plating test to be performed without passivation.

We claim:

1. A method of regenerating a passivated nickel-plating electrolytic bath containing nickel sulfamate, prior to nickel plating, said method comprising the steps of:

(a) subjecting the bath to a reduction treatment until the bath is unable to be used for electrolytic nickel-plating; and (b) slowly oxidizing said bath and stopping said oxidation when said bath is appropriate to be used for nickel-plating.

2. A method according to claim 1, wherein the reduction is performed by adding a chemically reducing agent that does not add a cation having a detrimental action on plating.

3. A method according to claim 1, further comprising maintaining said bath under an inert atmosphere during the reduction step.

4. A method according to claim 1, wherein said oxidation is performed using air at a temperature of less than 80° C. for a time of from half an hour to 24 hours.

5. A method according to claim 1, further comprising verifying bath regeneration, before subjecting said bath to said oxidation, by a nickel-plating test including:

(c) placing, in the nickel-plating bath, an anode electrode and a cathode electrode after they have been cleaned and polarized;

(d) applying a potential difference between the two electrodes sufficient to cause nickel to deposit on the cathode electrode;

(e) recording current between the electrodes and voltage across the electrodes as a function of time; and (f) verifying that the bath has reached a sufficient level of reduction from changes in the record.

6. A method of regenerating a nickel plating electrolytic bath containing nickel sulfamate, prior to nickel plating, said method comprising the steps of:

(a) subjecting the bath to a reduction treatment until the bath is unable to be used for electrolytic nickel-plating; and (b) slowly oxidizing said bath until it is appropriate for use for nickel-plating, wherein the reduction is performed by hydrogen produced by internal electrolysis of the bath and includes immersing a cathode and an anode in the bath and applying, between said anode and said cathode, a voltage between 5 volts and a minimum value having a current density of 0.03 $Ma/cm^2$, and for a duration of at least 1 hour.

7. A method according to claim 6, wherein said hydrogen-containing gas is hydrogen or a mixture of argon and hydrogen.

8. A method according to claim 6, wherein the cathode contains a metal constituting a hydrogenation catalyst.

9. A method according to claim 6, wherein said cathode is made of nickel or of platinum.

10. A method according to claim 9, wherein the surface area of the anode is at least equal to the surface area of the cathode.

11. A method of regenerating a nickel-plating electrolytic bath containing nickel sulfamate, prior to nickel plating, said method comprising the steps of:

(a) subjecting the bath to a reduction treatment until the bath is unable to be used for electrolytic nickel-plating; and (b) slowly oxidizing said bath until it is appropriate for use for nickel-plating, wherein reduction is carried out with hydrogen and is performed by bubbling a hydrogen-containing gas in the bath on a catalyst, simultaneously with or after a step of reduction by other means.

* * * * *